US012320559B2

(12) United States Patent
Chapin

(10) Patent No.: US 12,320,559 B2
(45) Date of Patent: Jun. 3, 2025

(54) INTERCHANGEABLE HEAT EXCHANGER ACCESS PANEL WITH ACCESSORY MOUNTING CAPABILITY

(71) Applicant: Midea Group Co., Ltd., Foshan (CN)

(72) Inventor: Zachary Chapin, Louisville, KY (US)

(73) Assignee: MIDEA GROUP CO., LTD., Guangdong (CN)

( * ) Notice: Subject to any disclaimer, the term of this patent is extended or adjusted under 35 U.S.C. 154(b) by 0 days.

(21) Appl. No.: 18/432,816

(22) Filed: Feb. 5, 2024

(65) Prior Publication Data

US 2024/0175609 A1 May 30, 2024

Related U.S. Application Data

(62) Division of application No. 17/483,167, filed on Sep. 23, 2021, now Pat. No. 11,892,207.

(51) Int. Cl.
*F25B 39/02* (2006.01)
*F25D 21/14* (2006.01)

(52) U.S. Cl.
CPC ..... *F25B 39/02* (2013.01); *F25D 21/14* (2013.01)

(58) Field of Classification Search
CPC ..... F24F 1/0063; F24F 13/30; F24F 13/32; F24F 13/22; F25D 21/14; F25D 2321/144; F25B 39/02
See application file for complete search history.

(56) References Cited

U.S. PATENT DOCUMENTS

| | | | | |
|---|---|---|---|---|
| 3,831,670 | A | 8/1974 | Mullings | |
| 4,461,345 | A | 7/1984 | Vandervaart | |
| 6,550,257 | B1 | 4/2003 | Goetzinger | |
| 6,782,708 | B1 | 8/2004 | Boer | |
| 6,932,494 | B1 | 8/2005 | Burnett | |
| 7,323,065 | B2 | 1/2008 | Fencl | |
| 7,370,489 | B2 | 5/2008 | Rios | |
| 9,157,642 | B2 | 10/2015 | Maeng | |
| 10,612,858 | B2 | 4/2020 | Seccuro | |
| 11,454,420 | B2 * | 9/2022 | Hoyt | F24F 13/30 |
| 2011/0011112 | A1 | 1/2011 | Goel | |
| 2017/0108230 | A1 | 4/2017 | Yamamoto | |
| 2017/0343239 | A1 | 11/2017 | Zunino, Jr. | |
| 2019/0376723 | A1 | 12/2019 | Rigg | |

(Continued)

OTHER PUBLICATIONS

Saxton, Evaporator Coil Cleaning, Saxton Air Duct Cleaning, Retrieved from: https://www.saxtonairductcleaning.com/evaporator-coil-cleaning.html, 7 pages, Retrieved on Apr. 7, 2021.

(Continued)

*Primary Examiner* — Henry T Crenshaw
*Assistant Examiner* — Kamran Tavakoldavani
(74) *Attorney, Agent, or Firm* — Gray Ice Higdon

(57) ABSTRACT

An air conditioning system including swappable/interchangeable heat exchanger access panels with accessory mounting capabilities is disclosed. The air conditioning system includes a heat exchanger, a drain pan beneath the heat exchanger to collect condensation from the heat exchanger, a bracket with an opening coupled to the heat exchanger, a plurality of interchangeable access panels adapted to be interchangeably mounted to the opening on the bracket, and an accessory coupled to one of the plurality of access panels.

21 Claims, 4 Drawing Sheets

(56) References Cited

U.S. PATENT DOCUMENTS

| | | | |
|---|---|---|---|
| 2020/0378647 | A1 | 12/2020 | Bauer |
| 2021/0080193 | A1* | 3/2021 | Christensen Phillips ..... F28D 1/0426 |
| 2021/0354080 | A1 | 11/2021 | Alejo |
| 2023/0093227 | A1 | 3/2023 | Chapin |

OTHER PUBLICATIONS

Thomas, Byron, HVAC UV Lights for AC Systems—Do They Work?, HouseSoGreen, Retrieved from: https://housesogreen.com/2014/07/hvac-uv-lights-for-ac-systems-do-they-work/, 6 pages, dated Jul. 17, 2014.

American Sheet Metal, 10×10 Galvanized Sheet Metal HVAC Access Door for Furnace Coil or Airhandler, Amazon, Retrieved from: https://www.amazon.com/Galvanized-Sheet-Access-Furnance-Airhandler/dp/B015G8AMJO, Retrieved on: Apr. 7, 2021.

* cited by examiner

INTERCHANGEABLE HEAT EXCHANGER ACCESS PANEL WITH ACCESSORY MOUNTING CAPABILITY

BACKGROUND

Air conditioning systems use heat exchangers, such as evaporator coils and condenser coils, to accomplish heating and cooling purposes. Since the heat exchangers are in airflow for the air passing through, cleanliness of the heat exchangers is critical for optimum functioning of the air conditioning systems. If the delicate fins on the surfaces of the heat exchangers become clogged with debris, the air flow passing through may become clogged, thereby causing system breakdowns. Thus, the heat exchangers need to be cleaned on a recurring basis, but access to the interior of the heat changers for cleaning purposes may be difficult in some situations. For example, the interior of an evaporator coil (also often referred as an A-coil for its triangular configuration) is frequently difficult to access. Also, one or more accessories, such as sensors, cameras, germicidal/UV lights, ionizers, etc., may be desired to be added to the heat exchanger for better operation of the air conditioning system, but the installation may be problematic with the existing design.

Accordingly, a need continues to exist for a manner and/or apparatus of easily accessing the interior of the heat exchangers and easily installing accessories to the heat exchangers if desired by the user.

SUMMARY

The herein-described embodiments address these and other problems associated with the art by providing swappable/interchangeable access panels to the existing heat exchangers that can be easily removed for accessing the interior. Various fastening features (e.g., screws, snaps or spring clips, pin and slots, swaged/flared pins, bendable tabs, etc.) may be provided to permit the access panels to be secured to the heat exchangers firmly without risk of loosening or displacement, while further easing the installation/removal process. In addition, the interchangeable access panels may be configured for mounting common accessories, such as germicidal/UV lights and/or ionizers for purposes such as sterilizing the passing air flow. The interchangeable access panels can be installed and/or removed by the manufacturers or consumers efficiently and easily, providing ability to replace due to damage and/or per user preferences. For example, in some embodiments, a solid access panel may be replaced with an access panel, according to an embodiment, with a pre-formed mounting slot with a perforated border that may accommodate one or more germicidal/UV lights that are commonly available for retail purchase.

In some embodiments, an air condition system may include a heat exchanger, a drain pan beneath the heat exchanger to collect condensation from the heat exchanger, a bracket with an opening coupled to the heat exchanger, a plurality of interchangeable access panels adapted to be interchangeably mounted to the opening on the bracket, and an accessory coupled to one of the plurality of access panels.

In some other embodiments, a heat exchanger for use in an air conditioning system may include a first coil sidewall and a second coil sidewall disposed at an acute angle to each other, a bracket coupled to edges of the first and second coil sidewalls, with an opening formed through the bracket; and a plurality of swappable/interchangeable access panels removable/detachable from the opening of the bracket. One or more of the plurality of access panels may have a pre-formed mounting feature for receiving an accessory.

In some further embodiments, a method of installing an accessory within a heat exchanger is disclosed. The heat exchanger may include a plurality of interchangeable access panels including at least a solid access panel and an access panel with a pre-formed accessory mounting feature. The method may include removing the solid access panel from the heat exchanger, selecting the access panel with the pre-formed accessory mounting feature from the plurality of interchangeable access panels for receiving an accessory, installing the accessory via the pre-formed mounting feature on the access panel, and attaching the access panel with the installed accessory back to the heat exchanger.

These and other advantages and features, which characterize the invention, are set forth in the claims annexed hereto. For a better understanding of the invention, and of the advantages and objectives attained through its use, reference should be made to the Drawings, and to the accompanying descriptive matter, in which there is described example embodiments of the invention. This summary is merely provided to introduce a selection of concepts that are further described below in the detailed description, and is not intended to identify key or essential features of the claimed subject matter, nor is it intended to be used as an aid in limiting the scope of the claimed subject matter.

DETAILED DESCRIPTION

The embodiments discussed hereinafter are directed in part to an air conditioning system, a heat exchanger, and a method therefor that utilize an access panel with ready-made mounting capabilities for accessory installations. The functionality of the improved system is a significant improvement over a standard heat exchanger design. The system described herein not only provides an easy access to the interior of the heat exchangers for purposes such as cleaning or installing additional accessories inside of the heat exchangers, but also enables a potential easy manner of installing accessories such as germicidal/UV lights and/or ionizers. The illustrated embodiments hereinafter focus on heat exchanger coil section in a duct of an air conditioning system, in this case an evaporator coil in a triangular configuration (commonly referred to as an A-coil), but it will be appreciated that the herein-described techniques may be used for other types of applications and in other types of components at various locations, not just the evaporator coil in the duct of the air conditioning system. Therefore, the invention is not limited to use solely with an air conditioning system, albeit this is a common application, so the figures will depict this common application.

The embodiments shown and described include an interchangeable access panel coupled to a bracket frame assembly that provides access to the interior of a heat exchanger (depicted in the figures as a typical A-coil). In the embodiments shown, the access panel may be coupled to the bracket frame on one side and/or both sides of the A-coil to allow access. As will be shown and described below, the access panel, is preferably, but not necessarily, equipped with a pre-formed mounting feature for additional accessory installations. For example, a user may choose from a solid access panel, an access panel with a perforated accessory mounting slot, and/or an access panel with a permanent accessory mounting slot according to their needs.

Figure 1:
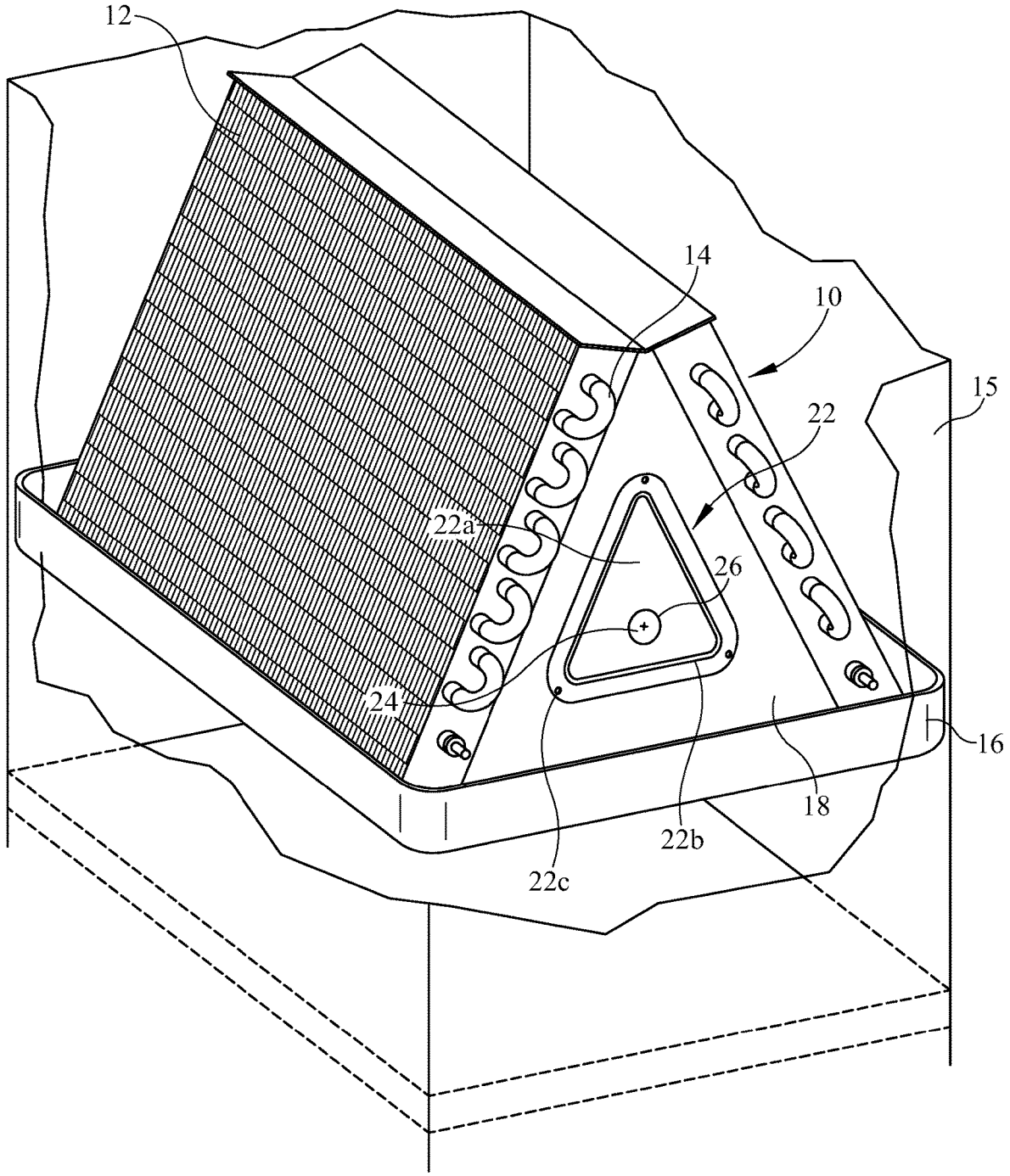
FIG. 1 is a perspective view of a heat exchanger with an access panel, according to an embodiment.

Turning now to the drawings, wherein like numbers denote like parts throughout the several views, FIG. 1 illustrates a generalized perspective view of the present invention. An evaporator coil 10 having a plurality of heat exchanger fins 12 and tubes 14 on its surfaces, is disposed in a duct 15 of an air conditioning system. In some embodiments, the coil 10 may have two coils sides connected at an acute angle to form a typical A-coil as shown here. In such embodiments, the coil 10 may further have a triangular front bracket panel or frame assembly 18 coupled to the opening on either and/or both sides of the coil 10 to create a tent-like enclosure with an open bottom. A drain pan 16 running about the perimeter of the open bottom of the coil 10 may be disposed below the coil 10, such that condensation from the coil 10 flows into the drain pan 16. In some embodiments, the bracket 18 may have a cut out or access opening 20 with an edge 20*a* to accept an access panel 22. It should be understood that the bracket 18 and/or the opening 20 may be in different configurations such as triangular, rectangular, circular, oval, or any other shapes/configurations, and it should be also understood that the dimensions and shapes/configuration of the access panel 22 may match with that of the opening 20 of the bracket 18 for fully covering.

In some embodiments, the access panel 22 may have a flat main panel portion 22*a* at its center and an offset peripheral flange 22*b* on its periphery for a better sealing effect and/or fastener connections. In some embodiments, the flange 22*b* may occupy a plane that is parallel to and offset inwardly/outwardly from the plane occupied by the main panel portion 22*a*, so the flange 22*b* may present a planar sealing surface on its outer side which seals against the edge 20*a* of the opening 20 when the access panel 22 is in place closing the opening 20. In some embodiments, the bracket 18 and/or the access panel 22 may also have one or more clearance holes 22*c* proximate the edge 20*a* and on the flange 22*b*, respectively, for one or more corresponding fasteners going through to seal the access panel 22 against the edge 20*a* of the opening 20. It should be understood that the fasteners may be any other suitable configurations/mechanisms, such as, a nut combined with a screw/shaft, geometric coupling (e.g., dovetails, tongue and grooves, pin and slots, etc.), and fasteners of many types (e.g., bolts, rivets, pins, ball detents, spring retainers, etc.). For example, in some embodiments, the access panel 22 may be installed by pressing it to fully cover the opening 20 of the bracket 18 with the flange 22*b* being against the edge 20*a* of the opening 20, then inserting one or more fasteners through the clearance holes 22*c* on the flange 22*b* of the access panel 22 and proximate the edge 20*a* of the opening 20 of the bracket 18 correspondingly as shown in FIG. 1.

Figure 2A:
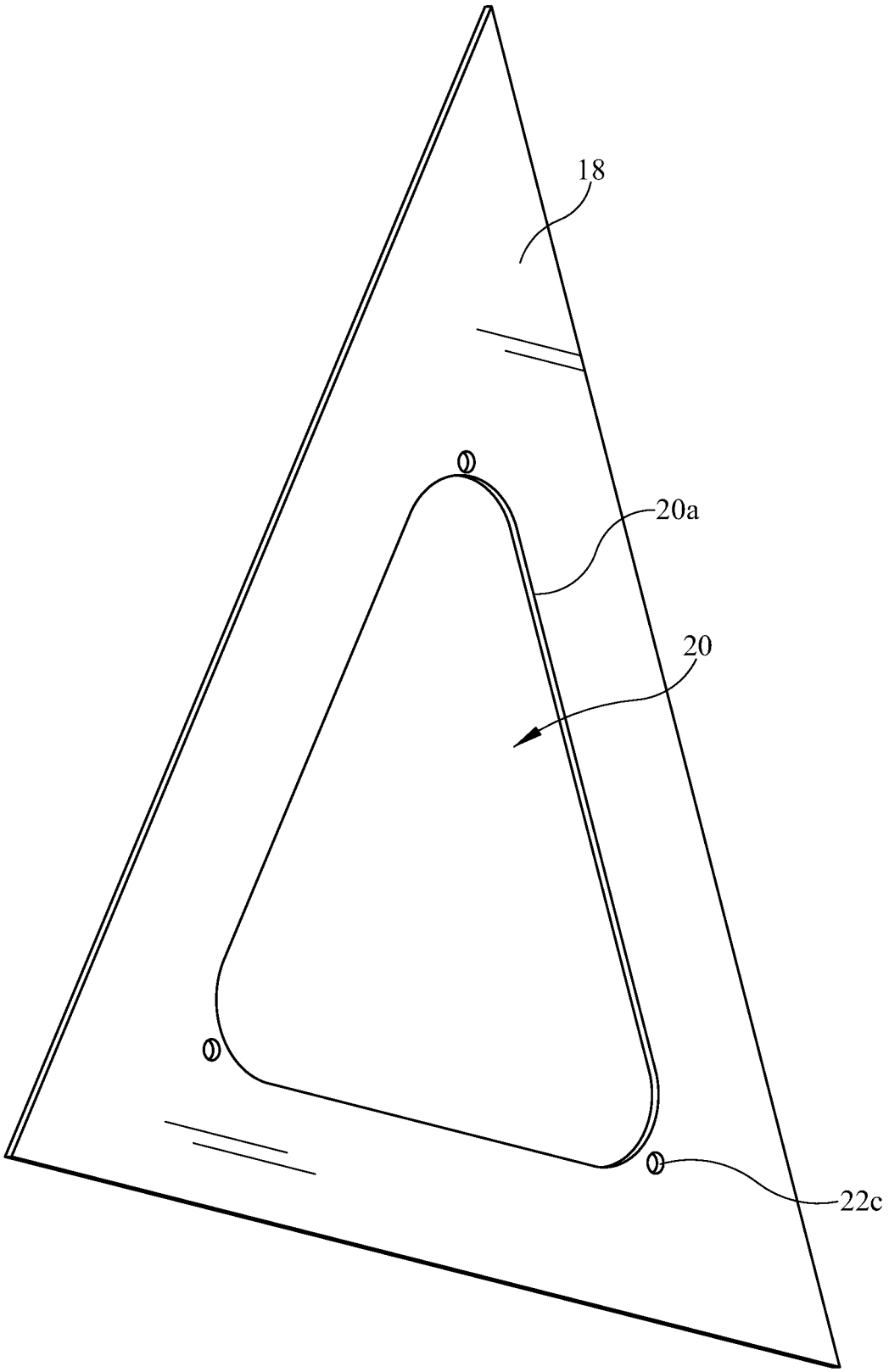
FIG. 2A is a perspective view of a bracket frame with an opening into which the access panel shown in FIG. 1 is to be mounted, according to one embodiment.

In some embodiments, the bracket 18 and/or the access panel 22 may be accompanied by a length of the gasket (not shown) sufficient to extend completely around the edge 20*a* of the opening 20 for potential better sealing effect. In some further embodiments, a locking mechanism in addition to the fastener may also be provided to prevent the access panel 22 from separating from the bracket 18 inadvertently. For example, a clip lock or toggle latch feature may be applied in addition with the fastener to further secure the access panel 22 in place during the operation of the air conditioning system. It should be understood that the access panel 22 may be mounted to cover the opening 20 of the bracket 18 with the various mounting options (e.g., screw on, snap on, swaged/flared pins, bendable tabs, hinged, etc.), providing the manufacturers or consumers with the ability of easy installation and/or replacement for appearance, functionality, or replacement of a damaged part. In some situations, when the access panel 22 is taken off from the bracket 18 as shown in FIG. 2A, the opening 20 may provide access to the interior of the coil 10 for case of cleaning the condensate, vacuuming, and/or installing or servicing certain mechanical or electrical components inside (e.g., LED lights, cameras, sensors, etc.). The access panel 22 may be positioned at different locations of the bracket 18 to cover the opening 20 at different locations as desired.

In different embodiments, the bracket 18 and the access panel 22 may be formed from various materials and applied with various coatings, which may compliment the anticorrosion requirements and the overall heat exchanger appearances. In some embodiments, the bracket 18 and the access panel 22 may be formed of a stamped member of sheet metal that is similar in appearance and material to what the coil 10 is made from. In some other embodiments, the bracket 18 and the access panel 22 may be formed from other metal materials, plastic, or suitable laminate materials to fit the appearance of the coil 10. In some embodiments, metal may be preferred as the temperature during the fabrication process may be too high for other materials.

Figure 2B:
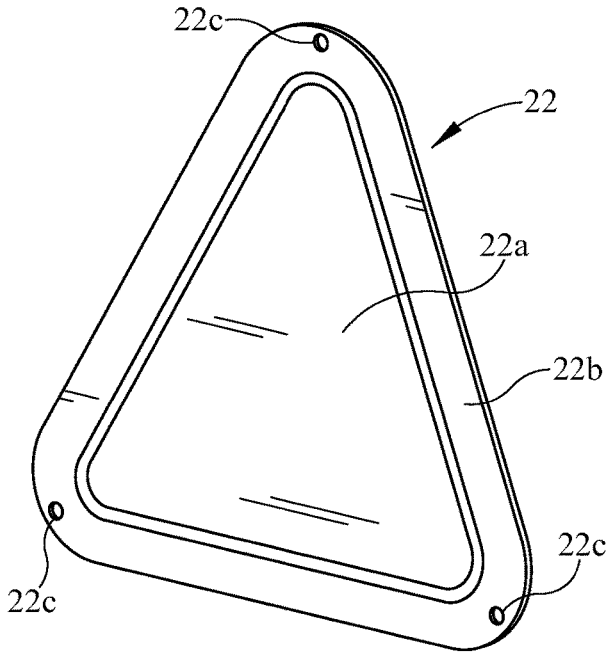
FIG. 2B is a perspective view of an access panel for coupling to the bracket frame of FIG. 2A, according to one embodiment.
Figure 2C:
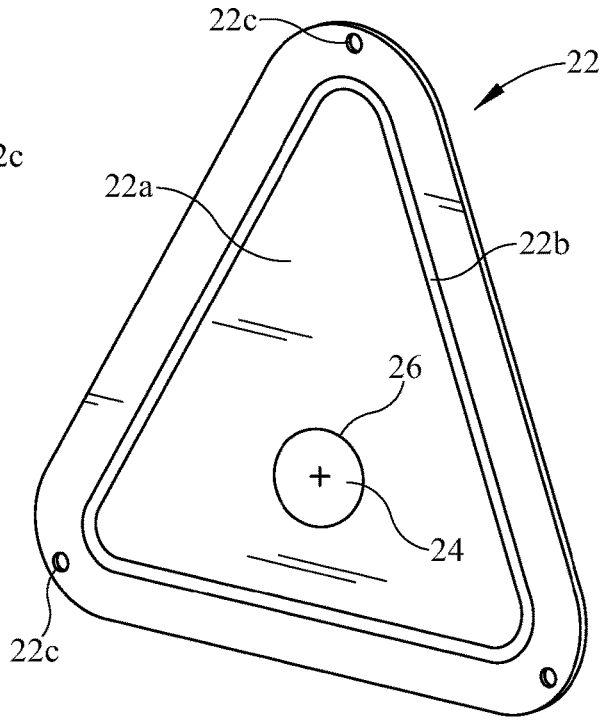
FIG. 2C is a perspective view of a different access panel for coupling to the bracket frame of FIG. 2A, according to one embodiment.
Figure 2D:
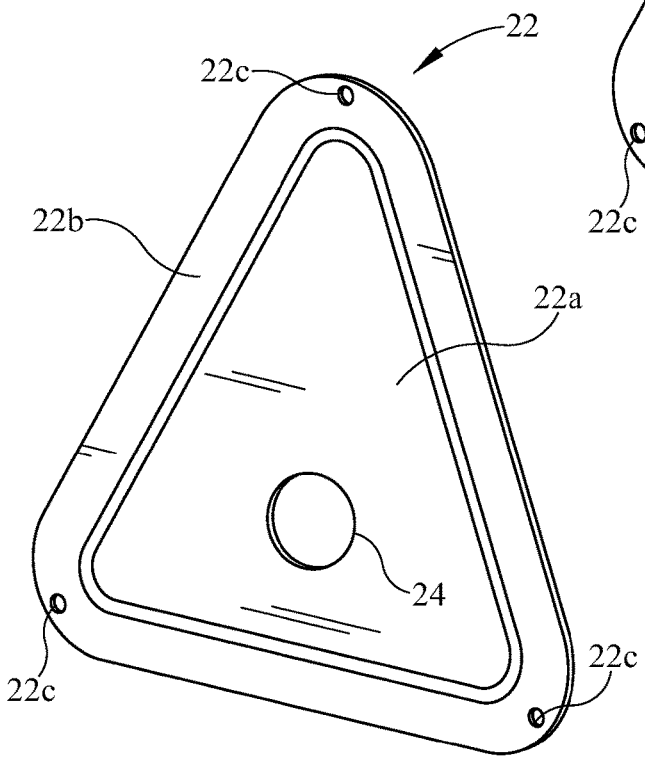
FIG. 2D is a perspective view of another different access panel for coupling to the bracket frame of FIG. 2A, according to one embodiment.

During operation, the airflow passing through the coil 10 is generally produced by a blower motor (not shown). Also, while the duct 15 of FIG. 1 is shown in a vertical configuration, it could be horizontal or at any angles in other configurations. When the air conditioning system is on, the air in the duct 15 is forced through the coil 10 by the blower motor, and the fins 12 and tubes 14 are cooled by the refrigeration cycle, hence air passing through is cooled as well. Cooling the air causes condensation to form on the fins 12 and the tubes 14, and gravity causes the condensation to flow towards the drain pan 16 for collecting the runoff condensation. Since the cool and moist environmental conditions inside of the coil 10 are conducive to microbial infestations, accessories such as germicidal/UV lights are often desired by the user. To facilitate the accessory installations, the disclosed heat exchangers may include a plurality of access panels 22 with different designs/configurations (e.g., with or without ready-made mounting features), and the bracket 18 as shown in FIG. 2A may be configured to receive the plurality of the access panels 22 as shown in FIGS. 2B-D. In some embodiments, the access panel 22 may have a ready-made mounting feature that is configured for mounting common accessories such as germicidal/UV lights and/or ionizers. For example, a common solid access panel 22 as shown in FIG. 2B may be replaced with a second access panel 22 as shown in FIG. 2C that has a perforated slot 24 with a perforated border 26 that is easily torn off or punched out if the user decides to add an accessory to the coil 10. In some further embodiments, a different access panel 22 as shown in FIG. 2D may have a permanent mounting slot 24. For example, in some embodiments, one end of a germicidal/UV light in a substantially linear tube configuration may be placed through the slot 24 on the access panel 22 for installation. It should be understood that the slot 24 may be replaced with any suitable tool-needed or tool-free mounting mechanisms, such as threaded fasteners, latches, and other mounting mechanisms. In summary, the plurality of swappable/interchangeable access panels 22 may be interchangeably coupled to the bracket 18 fixed on the coil 10 to facilitate a particular accessory installation desired by the user.

Figure 3:
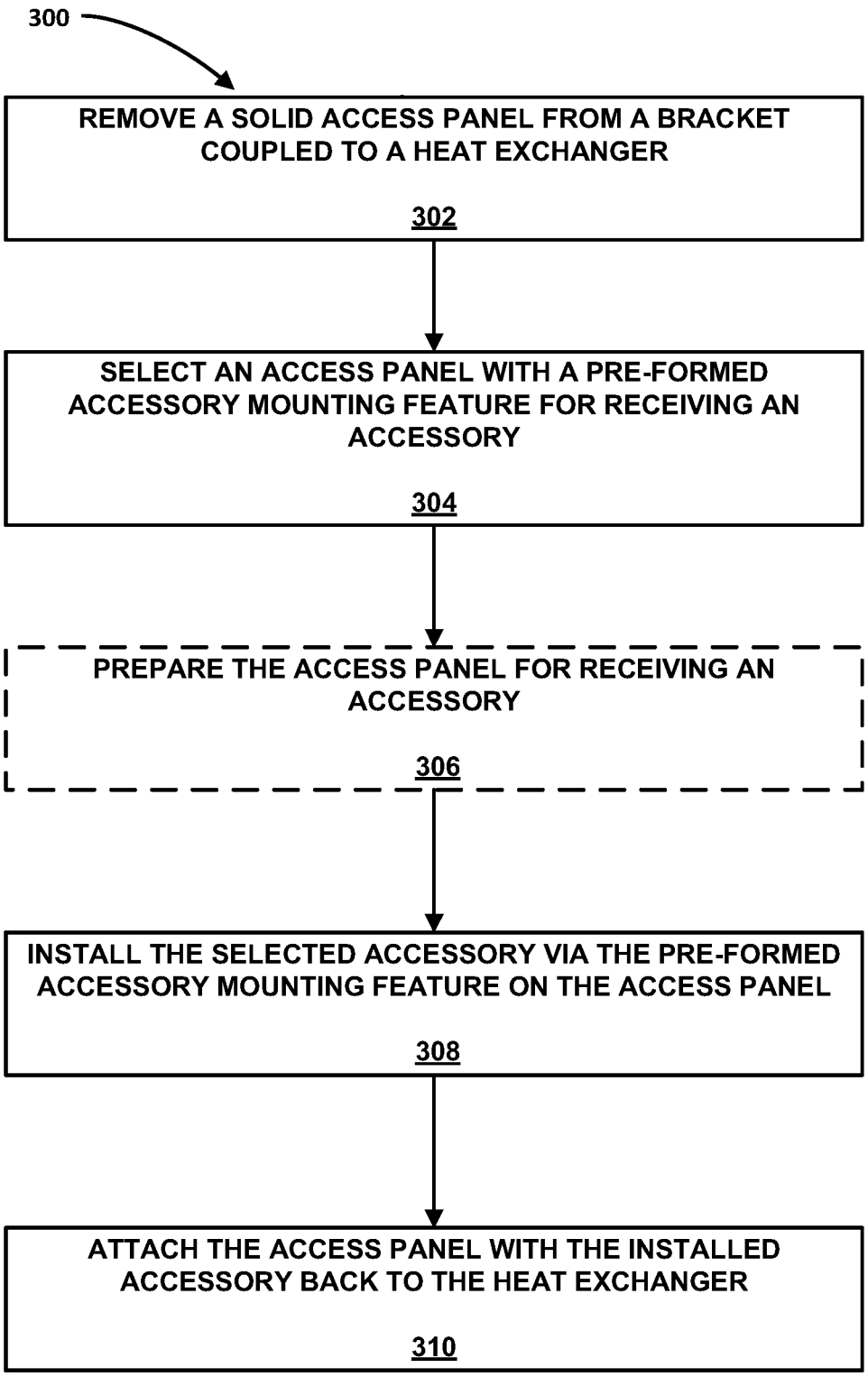
FIG. 3 is a flowchart illustrating an example sequence of installation of a selected accessory using an access panel, according to one embodiment.

FIG. 3 illustrates a flowchart of an example sequence 300 of operations for installing an accessory using the access panel 22. Sequence 300 begins in block 302 by removing the solid access panel 22 as shown in FIG. 2B from the bracket 18 fixed on the coil 10. Next, the user may choose an access panel 22 with a pre-formed mounting feature as shown in FIGS. 2C and 2D in block 304, and prepare the access panel for receiving an accessory if the pre-formed mounting feature is not ready such as the pre-formed slot 24 with the perforated border 26 as shown in FIG. 2C in dashed optional block 306. For example, the user may prepare the access panel 22 by tearing along the perforated border 26 of the perforated slot 24 in some embodiments. Consequently, the selected access panel 22 is ready to receive a selected accessory, such as germicidal/UV lights, ionizers, cameras, sensors, etc. Then, the selected accessory may be installed through the pre-formed mounting feature on the access panel 22 in block 308. With the selected accessory being installed, the access panel 22 may be attached back to the bracket 18 fixed on the coil 10. It should be understood that operations indicated by the block 308 and the block 310 may be reversed in some embodiments. For example, the selected accessory may be installed on the access panel 22 after the access panel 22 is attached back to the bracket 18.

In general, it should be understood that some features described above do not constitute limitations of the present disclosure, but rather have only been described for the sake of completeness. Instead, the present disclosure is particularly directed to an interchangeable access panel 22 configuration along with a bracket frame 18 affixed on a coil 10. It should also be understood that the bracket frame 18 and/or the access panel 22 may be a variety of constructions, shapes, sizes, quantities, and positions but still accomplish the same intent. It should be understood that the disclosed apparatus is not limited to an access panel for covering an access opening of an evaporator coil, and may also be used to cover openings, slots, and/or gaps formed in other similar structures. The concept could apply to any product that requires a cosmetic or functional cover applied over a mounting base portion of a given product. It should be understood that the figures only illustrate a representative side of the coil 10 as an embodiment of the disclosure. While only one side of the coil 10 is shown, it should be also understood that only one or each side of the coil 10 may be constructed in like manner. Besides the disclosed pre-formed accessory mounting features, the access panel 22 depicted in the accompanying figures may include additional components/features, and that some of the components/features described in those figures may be removed and/or modified without departing from scopes of the elements disclosed herein. The elements depicted in the figures may not be drawn to scale and thus, the elements may have different sizes and/or configurations other than as shown in the figures.

While several embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings is/are used. Those skilled in the art will recognize, or be able to ascertain using no more than routine experimentation, many equivalents to the specific embodiments described herein. It is, therefore, to be understood that the foregoing embodiments are presented by way of example only and that, within the scope of the appended claims and equivalents thereto, embodiments may be practiced otherwise than as specifically described and claimed. Embodiments of the present disclosure are directed to each individual feature, system, article, material, and/or method described herein. In addition, any combination of two or more such features, systems, articles, materials, and/or methods, if such features, systems, articles, materials, and/or methods are not mutually inconsistent, is included within the scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

It is to be understood that the embodiments are not limited in its application to the details of construction and the arrangement of components set forth in the description or illustrated in the drawings. The invention is capable of other embodiments and of being practiced or of being carried out in various ways. Unless limited otherwise, the terms "connected," "coupled," "in communication with," and "mounted," and variations thereof herein are used broadly and encompass direct and indirect connections, couplings, and mountings. In addition, the terms "connected" and "coupled" and variations thereof are not restricted to physical or mechanical connections or couplings.

The foregoing description of several embodiments of the invention has been presented for purposes of illustration. It is not intended to be exhaustive or to limit the invention to the precise steps and/or forms disclosed, and obviously many modifications and variations are possible in light of the above teaching.

What is claimed is:

1. A method of installing an accessory within a heat exchanger, wherein the heat exchanger comprises a plurality of interchangeable access panels including at least a solid access panel and an access panel with a pre-formed accessory mounting feature, comprising:

(a) removing the solid access panel from the heat exchanger;

(b) selecting the access panel with the pre-formed accessory mounting feature from the plurality of interchangeable access panels for receiving an accessory;

(c) installing the accessory via the pre-formed mounting feature on the access panel; and (d) attaching the access panel with the installed accessory back to the heat exchanger using one or more fasteners.

2. The method of claim 1, further comprising a step of preparing the access panel for receiving the accessory.

3. The method of claim 2, wherein preparing the access panel for receiving the accessory comprises tearing along a perforated border of a perforated slot on the access panel.

4. The method of claim 1, wherein the order of (c) installing the accessory via the pre-formed mounting feature on the access panel; and (d) attaching the access panel with the installed accessory back to the heat exchanger is reversed.

5. The method of claim 1, providing a bracket having an opening coupled to the heat exchanger, wherein attaching the access panel includes attaching the access panel to the opening of the bracket, and wherein the bracket and/or the access panel comprises an offset flange and/or a clearance hole for coupling to each other.

6. The method of claim 5, wherein the bracket and the access panel are both in triangular configurations.

7. The method of claim 1, wherein the heat exchanger is an A-coil heat exchanger.

8. A method of installing an accessory within a heat exchanger, wherein the heat exchanger comprises a plurality of interchangeable access panels including at least an access panel with a pre-formed accessory mounting feature, comprising:

selecting the access panel with the pre-formed accessory mounting feature from the plurality of interchangeable access panels for receiving one or more accessories, wherein the one or more accessories is at least one of a germicidal light, a UV light, an ionizer, a camera, and/or a sensor;

installing the one or more accessories via the pre-formed mounting feature on the access panel; and attaching the access panel to the heat exchanger.

9. The method of claim 8, further comprising selecting an accessory of the one or more accessories.

10. The method of claim 8, wherein attaching the access panel to the heat exchanger occurs after installing the one or more accessories via the pre-formed mounting feature on the access panel.

11. The method of claim 8, wherein attaching the access panel to the heat exchanger occurs before installing the one or more accessories via the pre-formed mounting feature on the access panel.

12. The method of claim 8, further comprising preparing the access panel for receiving the one or more accessories.

13. The method of claim 12, wherein preparing the access panel for receiving the one or more accessories comprises tearing along a perforated border of a perforated slot on the access panel.

14. The method of claim 8, wherein the heat exchanger includes a bracket defining an opening to receive the access panel.

15. The method of claim 14, further comprising removing a solid access panel from the opening of the bracket.

16. A method of installing an accessory within a heat exchanger, wherein the heat exchanger comprises a plurality of interchangeable access panels including at least an access panel with a pre-formed accessory mounting feature, comprising:

providing the heat exchanger having a first coil sidewall and a second coil sidewall disposed at an acute angle to each other, and a bracket coupled to edges of the first coil sidewall and the second coil sidewall, with an opening formed through the bracket;

selecting the access panel with the pre-formed accessory mounting feature from the plurality of interchangeable access panels for receiving one or more accessories;

installing the one or more accessories via the pre-formed mounting feature on the access panel; and attaching the access panel to the opening of the bracket of the heat exchanger using one or more fasteners.

17. The method of claim 16, further comprising selecting an accessory of the one or more accessories.

18. The method of claim 16, wherein attaching the access panel to the bracket occurs after installing the one or more accessories via the pre-formed mounting feature on the access panel.

19. The method of claim 16, wherein attaching the access panel to the bracket occurs before installing the one or more accessories via the pre-formed mounting feature on the access panel.

20. The method of claim 16, further comprising preparing the access panel for receiving the one or more accessories.

21. The method of claim 16, further comprising removing a solid access panel from the opening of the bracket.

* * * * *